United States Patent [19]

Spence-Bate

[11] 4,160,545

[45] Jul. 10, 1979

[54] FILM HANDLING APPARATUS

[76] Inventor: Harry A. H. Spence-Bate, 115 Cheam Plate, Morley, Australia, 6062

[21] Appl. No.: 594,095

[22] Filed: Jul. 8, 1975

[30] Foreign Application Priority Data

Jul. 11, 1974 [AU] Australia ..... 8172/74
Jul. 23, 1974 [AU] Australia ..... 8301/74

[51] Int. Cl.[2] ..... B65G 59/04; B65H 3/12

[52] U.S. Cl. ..... 271/106; 271/107; 271/102; 354/276; 53/520

[58] Field of Search ..... 271/106, 102, 131, 143, 271/132, 107; 354/174, 176, 275, 276; 53/123

[56] References Cited

U.S. PATENT DOCUMENTS

| | | | |
|---|---|---|---|
| 1,638,552 | 8/1927 | Ruttan | 354/276 |
| 2,848,228 | 8/1958 | Kimbro | 271/106 |
| 3,019,579 | 2/1962 | Heckman | 53/123 |
| 3,265,383 | 8/1966 | Shute | 271/107 |
| 3,510,126 | 5/1970 | Romanens | 271/102 |
| 3,684,276 | 8/1972 | Bridgeman | 271/106 |
| 3,866,764 | 2/1975 | Leiser | 271/106 |

*Primary Examiner*—Donald R. Schran
*Attorney, Agent, or Firm*—Fidelman, Wolffe & Waldron

[57] ABSTRACT

Film handling apparatus preferably for handling microfiche film in which a holder or cassette is provided and is locatable at a film pick-up station; the holder or cassette has engaging means preferably provided as a lip to engage at least one marginal portion of the top microfiche lamina of a stack of laminae held within the holder or cassette; a suction means being provided in the apparatus which by means of preferably two or more suction areas is enabled to progressively suck the top lamina from the holder or cassette; in one embodiment two similar suction means are provided as suction platens which move in close relationship on guides within the apparatus to position the lamina at a filming and titling station.

7 Claims, 28 Drawing Figures

FIG. 4
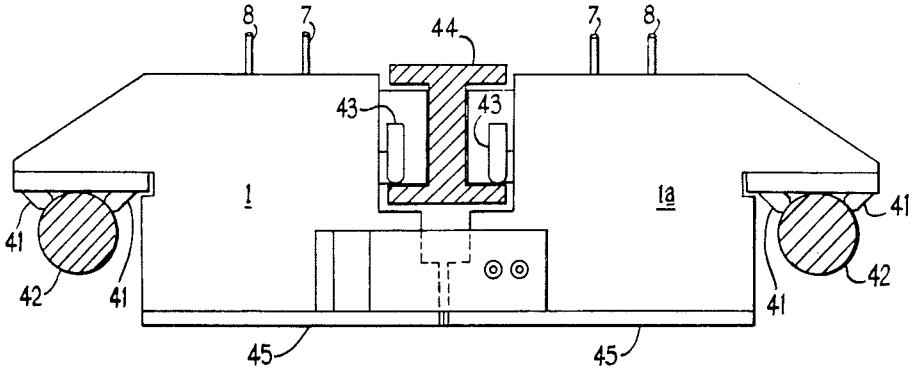
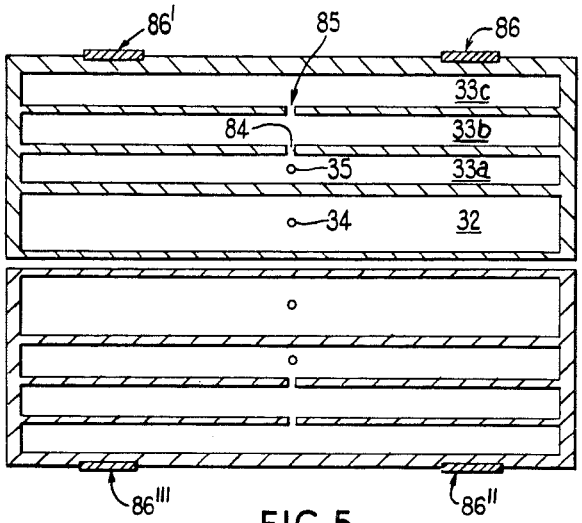
FIG. 5

FILM HANDLING APPARATUS

The present invention relates to handling apparatus for laminae, in particular but not exclusively for photographic film laminae such as microfiche.

Laminae in the form of sheets of paper, card or photographic film are conveniently stored in a stack or pile. Such a stack or pile normally requires some form of holder especially if the stack is to be moved. In the context of a microfiche camera which is designed to handle a plurality of michrofiche laminae it is convenient to provide a cassette. A problem with such cassette is, however, the extraction of the laminae one by one from the cassette. Manually this can be done quite easily but automatic extraction poses various problems not the least of which is how to grip an individual lamina.

An object of the present invention is to provide a holder or cassette enabling easy extraction of laminae from the cassette. A further object of the present invention is also to provide a handling device for extracting, holding and releasing a lamina.

Handling apparatus according to the present invention consists in a holder adapted to hold at least one lamina at a pick-up station, engaging means provided on said holder for engaging at least one marginal portion of the lamina, a handling device arranged to be positioned at the pick-up station in adjacent relationship to the lamina, the device being adapted to attract and hold by suction means one area of the lamina remote from the engaging means so as to remove the lamina from the holder.

The handling device is preferably provided with two similar suction platens and in one embodiment of the invention these are mounted in close relationship on guides. The suction platens may be provided with control means so that the suction platens can work together or separately. In an alternative embodiment three similar suction platens are provided.

The suction platens are each preferably provided with separate suction chambers which communicate with apertures in the suction platen, one said suction chamber providing suction via one set of said apertures to attract and hold said one area of the lamina remote from the engaging means, another said suction chamber providing suction via a further set of said apertures to attract and hold another area of the lamina adjacent or nearest the edge of the lamina, the platens.

The engaging means of the holder is preferably a lip on the holder, the holder being provided with a lamina feed means which may be a spring within the holder or a separate means provided externally of the holder but which is arranged to enter the holder.

The invention will now be described with reference to the accompanying drawings, in which:

FIG. 4 shows an end view of the split platen as mounted in a microfiche camera, FIG. 5 shows a cross-sectional plan view of a modified split platen showing the arrangement of suction chambers.

Figure 1:
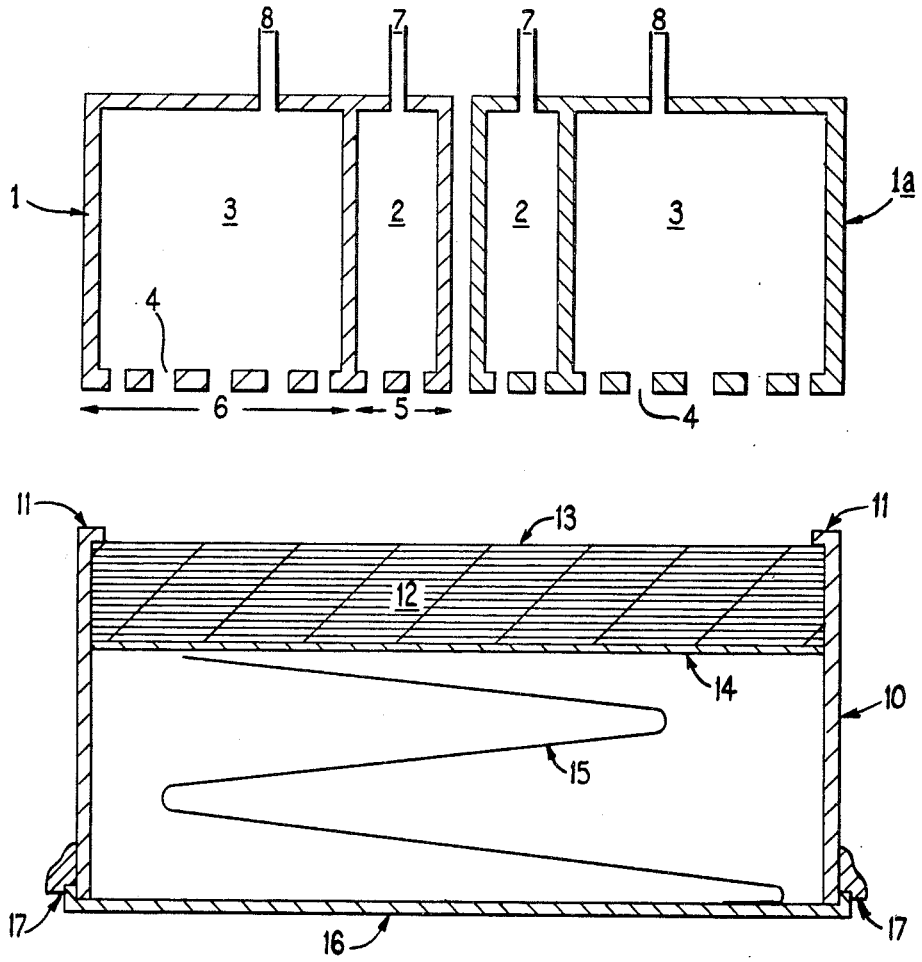
FIG. 1 shows in cross-section an elevation of a holder for laminae with two suction platens referred to as a double or split platen.

As shown in FIG. 1, the handling apparatus includes a handling device consisting of a first suction platen 1 and a second suction platen 1*a*. The platens 1 and 1*a* are located above a holder or cassette 10 in which a stack 12 of microfiche laminae are held.

The holder or cassette 10 is located at a transfer station where laminae are transferred from the cassette to the split platen. The cassette is provided with lips 11 acting as engaging means on its upper open end. The lips engage two marginal edges of the top lamina 13 so as to hold the lamina 13 in the cassette. A lamina feed means is provided in the cassette 10 to feed the stack of laminae 12 up against the lips 11, the feed means consisting of a spring 15 acting on the bottom 16 of the cassette and against a pusher plate 14 which is urged upwards under the stack 12. The bottom 16 of the cassette may be removed for recharging the cassette and is held onto the cassette by clip retainers 17.

The spring operated feed means shown in FIG. 1 is advantageous in some cameras but an alternative arrangement is shown in FIG. 4 which has certain advantages in other cameras. This alternative arrangement will be described subsequently.

The split platen consisting of two suctions platens 1 is shown in FIG. 1. Each platen has a primary or inner suction chamber 2 and a second or outer suction chamber 3 connecting respectively with a first set of apertures in a first suction area 5 and a second set of apertures in a second suction area 6 having individual apertures 4 in the suction platen face. Suction chambers 2 and chambers 3 have respectively exhaust conduits 7 and 8 connected to sources of suction via appropriate valves in a control device for admitting or not as required suction to the chambers.

Suitable arrangements in the control device are provided to sense the fact that the primary chamber has collected a microfiche and that the microfiche is partly withdrawn out of the cassette.

Arrangements can also be made to provide a fail-safe device so that if the vacuum supplied to the chambers fails, the microfiche does not fall off and become irrecoverable by the machine. Such a device could consist of a mechanically sprung retaining means mounted on the platens which would come into operation if the vacuum fell to less than a predetermined figure or if an electrical failure occurred in the suction pump circuit.

The arrangements for mounting the suction platens 1 and 1*a* in a microfiche camera are shown in FIG. 4. In FIG. 4 it can be seen that the platens are each provided on their outer sides with two sets of rollers 41 which run on rails 42 having a circular cross-section. On the inner sides of each platen rollers 43 are provided which run on the lower flanges of rail 44 of "I" cross-section. Each platen is shown as having a ground precision platen 45 in which the suction apertures are formed. The platens 45 can be manufactured to high accuracy which prevents excessive cavitation and the apertures can then be made as a large number of small fine holes.

Figure 2:
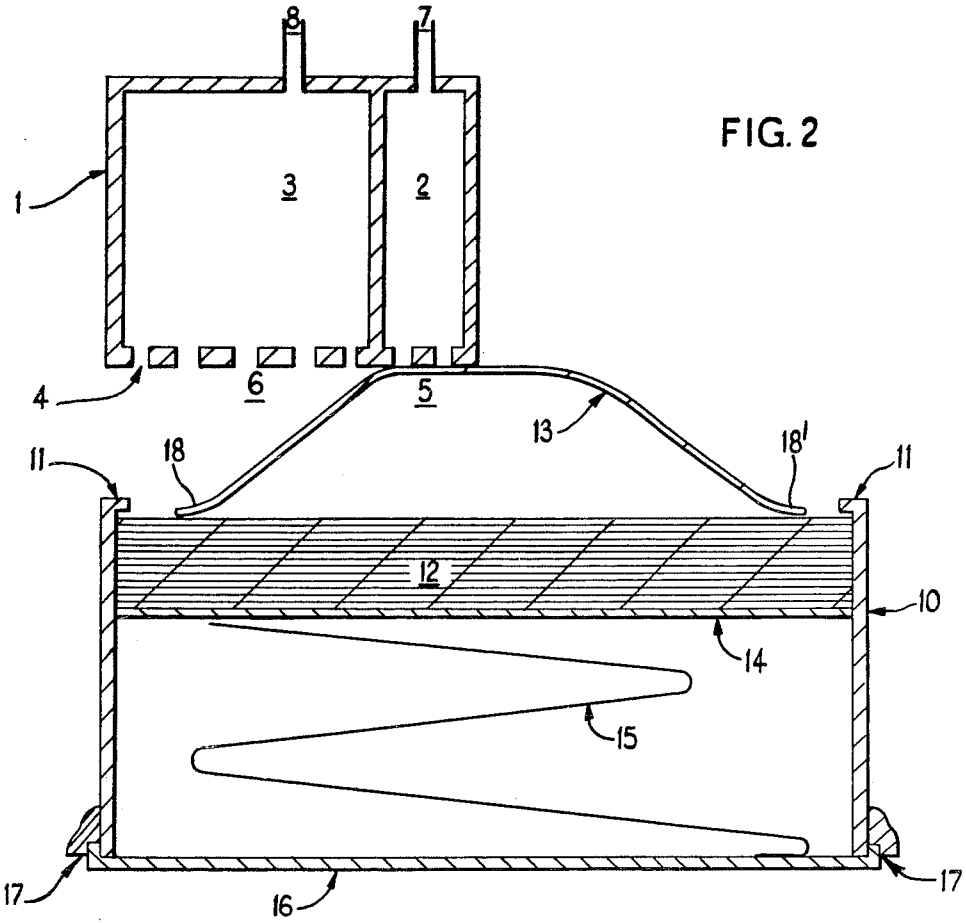
FIG. 2 shows the holder shown in FIG. 1 with one half of the split platen starting to suck a lamina out of the holder.
Figure 3:
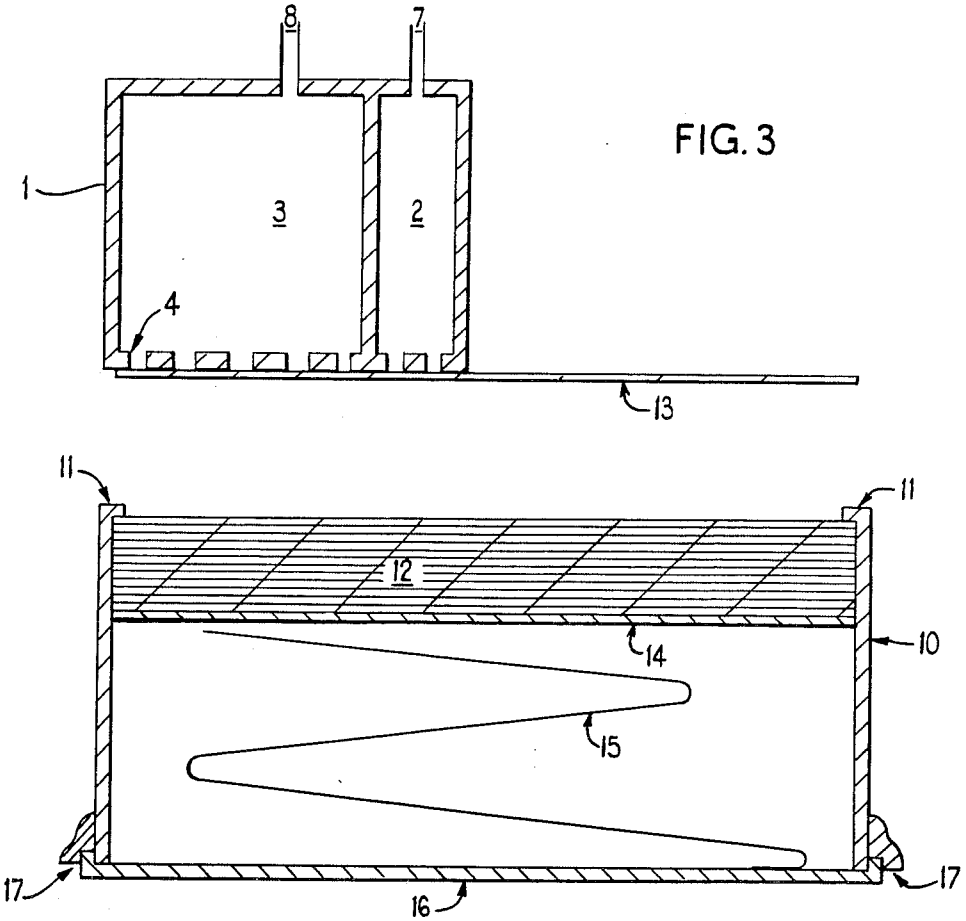
FIG. 3 shows the holder shown in FIG. 2 with the lamina extracted from the holder and retained on the platen.

The operation of the split platen is shown in FIGS. 2 and 3. In order to extract the uppermost film lamina 13 from the holder or cassette 10, platen 1 moved along rails 44 and 42 to a pick-up station immediately above the cassette 10 and in adjacent relationship to the lamina 13. Inner chamber 2 is then exhausted via conduit 7; a suction is applied to the inner chamber and a central area of the lamina 13 remote from the engaging means or lips is sucked onto the first suction area 5 of the platen. As this happens the marginal portions 18 and 18' of the lamina are drawn away from the retaining lips 11 and the laminae is thereby detached from the cassette. As soon as this has happened suction is then applied to the outer chamber 3. Marginal portion 18 of the lamina now starts to lift toward the second suction area 6 partly due to its own resilience and partly due to the suction applied. At the same time the other marginal portion 18' starts to lift due solely to the resilience of the lamina and the lamina then straightens out into the position shown in FIG. 3 in which half of the lamina is held flat on platen 1 and half is unsupported and projects into a position which can be occupied by platen 1*a*.

In the microfiche camera platen 1 then moves lamina 13 from the pick-up station to a filming station in the optical path of the camera lens. On completion of filming platen 1*a* moves alongside platen 1 and suction is applied in the same way as already described starting at the inner chamber 2 to grip lamina 13 suction is then released from platen 1 and the lamina is taken from the filming station to a tilting or release station. Meanwhile platen 1 returns to the pick-up station for a further lamina. It will be appreciated that a camera provided with such an arrangement is enabled to simultaneously film, pick-up and release or title and there is little or no delay in feeding the film to the filming station.

In a modified split platen shown in FIG. 5 further suction chambers are provided and these are inter-connected in such a way as to assist in flattening out a microfiche on the platen. The importance of this can be appreciated when it is realised that in microfiche work where images on the film are very small any distortion on the film during filming can considerably distort a subsequently magnified image reproduced from the microfiche.

In the split platen of FIG. 5 each platen has four suction chambers 32, 33*a*, 33*b*, and 33*c* in two sections, the first section has inner chamber 32 connected to the first suction area and the outer chambers 33*a*, *b* and *c* are in a second section connected to the second suction area. Conduits 34 and 35 provide suction to the first and second sections respectively. Conduit 35 is connected to chamber 33*a* which is then connected via a conduit 84 to chamber 33*b* which is in turn connected via conduit 85 to chamber 33*c*. Thus when suction is applied to the outer chambers it first applies at the inner of the outer chambers 33*a*. As the vacuum increases in chamber 33*a* due to the microfiche closing off the apertures in the suction area, the vacuum starts to apply in the next chamber 33*b*. Thus a film first held by the inner chamber 32 is progressively flattened onto the platen. When the microfiche is firmly attracted to the portion of the suction area under chamber 33*c* the vacuum increases to a certain level and an indication is given to a switch in an electrical control circuit which initiates the next stage of the camera operation.

In FIG. 5 there is also shown part of the fail-safe device previously described. This includes retaining means 86, 86', 86'' and 86'' provided at the outer extremities of the platens.

Figure 6:
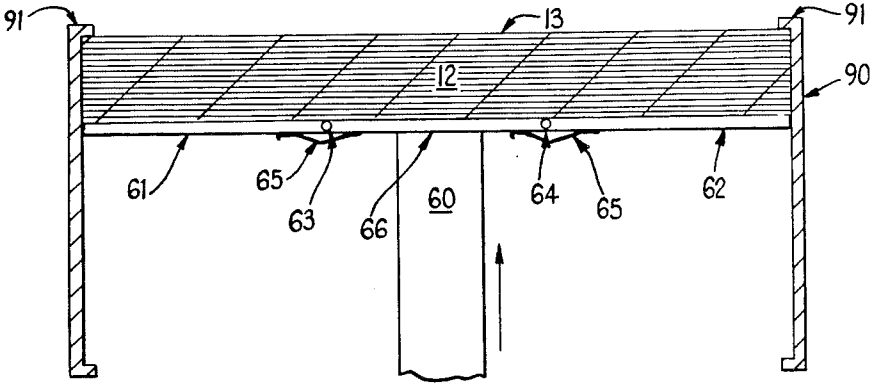
FIG. 6 shows a holder according to this invention with modified lamina feed.

In FIG. 6 there is shown a modified holder or cassette 90. Here instead of the self contained spring feed arrangement of the cassette shown in FIGS. 1 to 3, an exterior feeding arrangement is provided. In this cassette 90 separate means 60 formed as an external pushing device is provided. Means 60 pushes on a centre portion 66 of a pusher. Hinged at 63 and 64 to the centre portion 66 are respectively pushing members 61 and 62. These are maintained in a level position by leaf springs 65. This hinged arrangement is so that when pushing the stack or pile 12 of laminae upwards the centre portion 66 acts with a force given to the means 60 whilst the force acting on the lips 91 is reduced by an amount due to the reduced rigidity of the leaf spring 65. This permits the pushing device to assist the suction platen 65 achieve better contact with the lamina 13 whilst not making the lips 91 grip too hard. The arrangement is useful if the laminae have a tendency to curl. It will be appreciated that this externally pushed arrangement is advantageous in that the cassette can contain more laminae of a given size of cassette than a cassette with an internally sprung pushing device. This is because the internal springing arrangement takes up space otherwise used for storing laminae. Further arrangements or modifications of holder for laminae will be described with reference to FIGS. 15 to 24.

Figure 7:
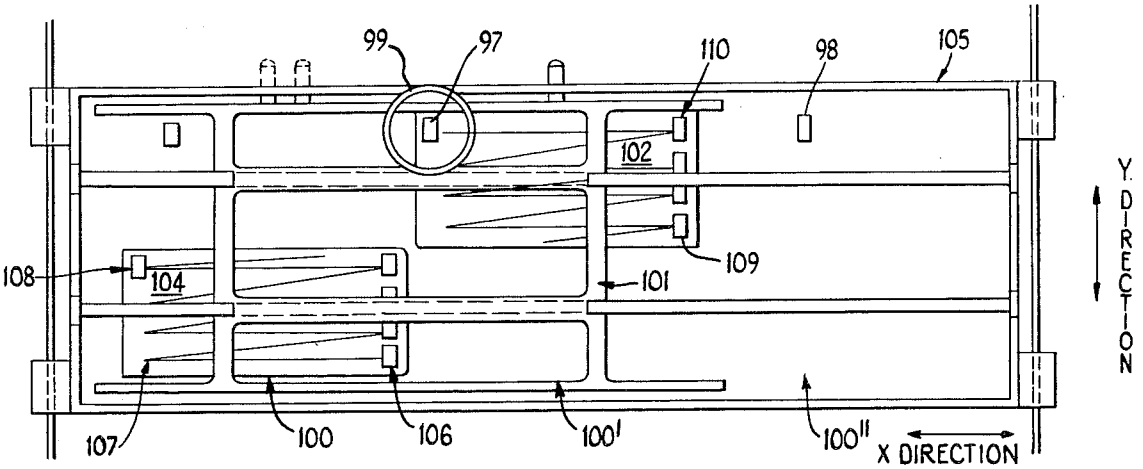
FIG. 7 shows a plan view of a microfiche camera with two split platens according to the invention.
Figure 7A:
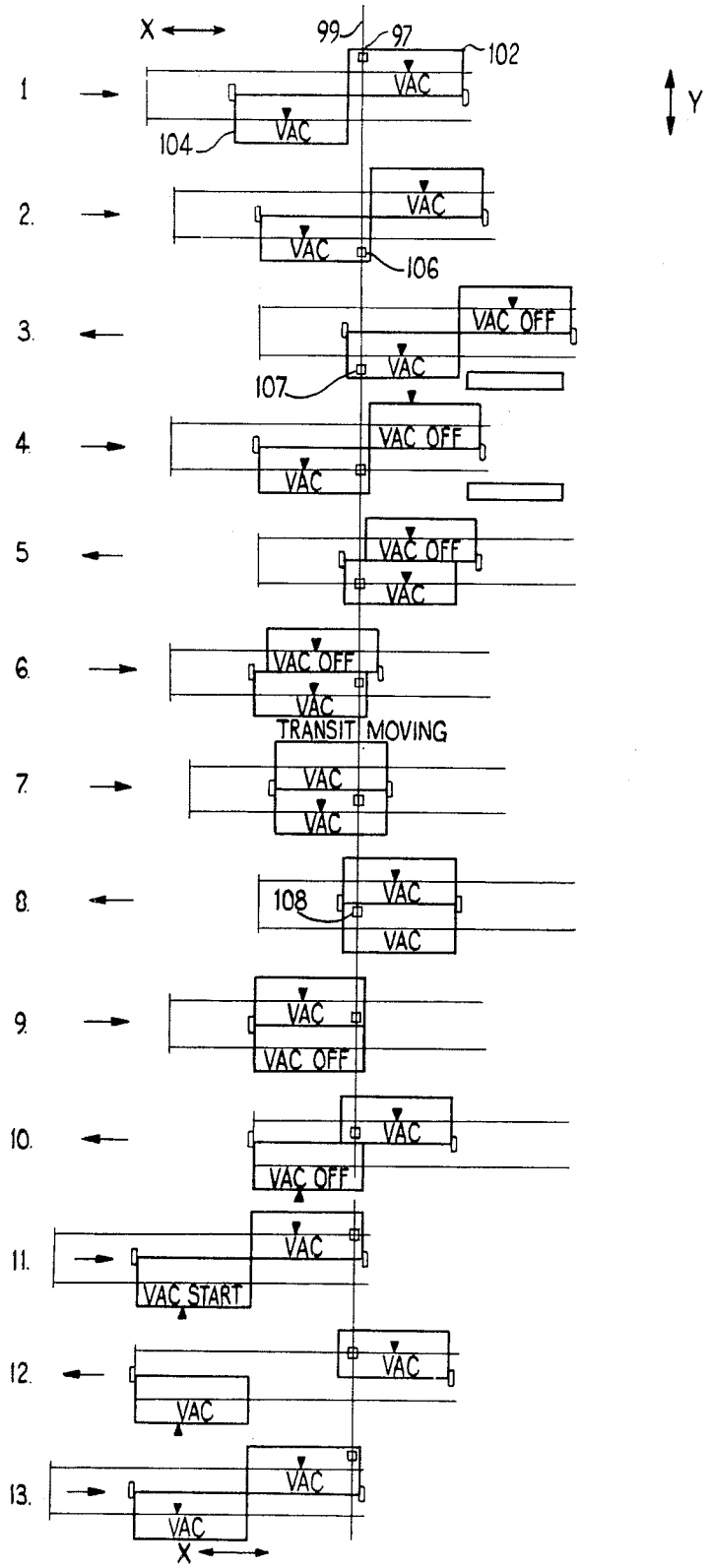
FIG. 7A is a diagram of suction programming for the camera of FIG. 7.

In FIG. 7 there is shown a plan view of one double or split platen arrangement which uses the arrangement essentially shown in FIG. 1. In FIG. 7 there is shown an inner frame 101 which is arranged to move in the 'X' direction on slides or guides (not shown) on an outer or main frame 105 which is enabled to be a similar manner in the 'Y' direction. Both frames are moved by positioning mechanisms or activators which are not shown but which may be of a kind shown in other patents or patent applications by the inventor or as will be shown in FIGS. 11 to 14 in this specification. On the inner frame 101 two split platens 102 and 104 are provided which are controlled to move between a pick-up station 100 to a filming station 100' and to a titling and release station 100''. At the pick-up station is a holder or cassette (not shown); at the filming station is a lens indicated by double circle 99; and at the titling station a separate titling arrangement 98 is provided. Movement between stations is shown in FIG. 7A where the lens position 99 is at the filming station is shown as a line. At stage 1 the platens are in the position shown in FIG. 7 where the last image 97 is being filmed at lens position 99. Platen 104 has the follow-up microfiche lamina at the pick-up station attached to it by suction. Outer frame 105 then moves in the 'Y' direction as in stage 2 which with some cassettes can be used to withdraw the lamina from the cassette. Inner frame 101 then moves in an 'X' direction to bring image 106 to lens position 99 as shown in stage 2, image 106 being the first image on the follow-up microfiche. Images are then filmed along the 'X' axis until end of the row 107 is reached (see FIG. 7). At this stage platen 102 can be programmed to undergo a variety of actions depending on the further process of the microfiche attached to it. For most purposes platen 102 is released from inner frame 101 and locked to outer frame 105. The microfiche normally is either disposed of into a titling device at station 98 or released into a receiving cassette, chute or conveyor. This is indicated at stage 3 in FIG. 7A. Filming is carried on the follow-up to microfiche as indicated at stages 4 to 6 but meanwhile platen 102 has been realigned with platen 104 as shown in stage 7 and suction has been applied to both halves thus ensuring the microfiche is held by both platens. At stage 8 it will be seen that the last image 108 has been filmed and at stage 9 the follow up microfiche has now been released by platen 104 which is free to return to pick-up another microfiche at stages 10 to 13.

In the arrangement shown in FIGS. 7 and 7A microfiche withdrawal from the cassette is arranged to take place in the 'Y' direction but in other arrangements the X direction is used.

Figure 26:
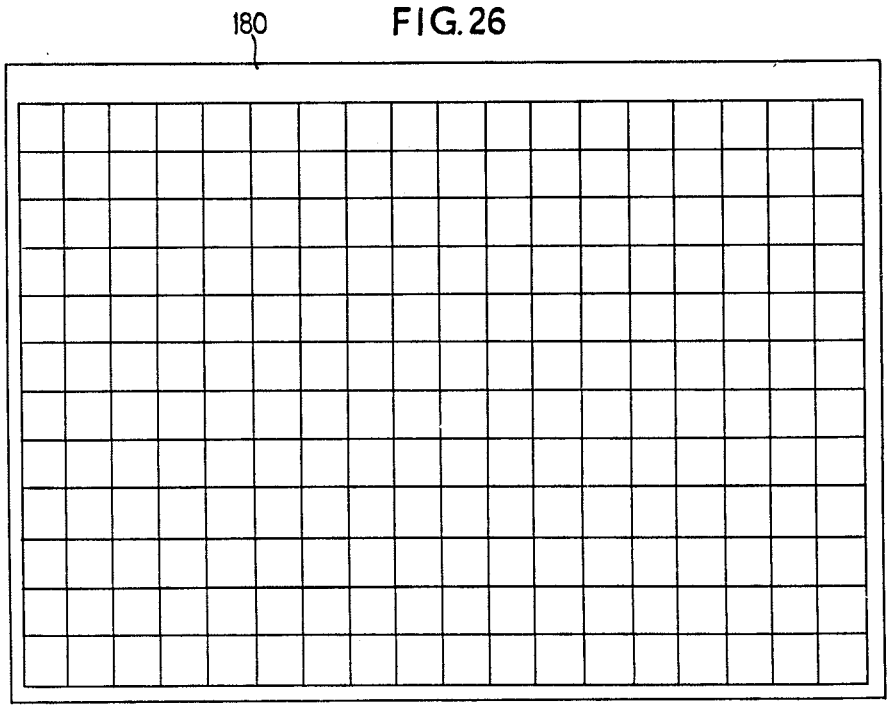

For computer to microfiche recording a convenient arrangement of images is as shown in FIG. 26 where there are 12 rows and 18 columns of square images on standard microfiche 148 mm by 105 mm. At the top of this microfiche a 5 mm wide identification space is left. In a preferred recording programme a square wave image recording path is followed.

Figure 8A:
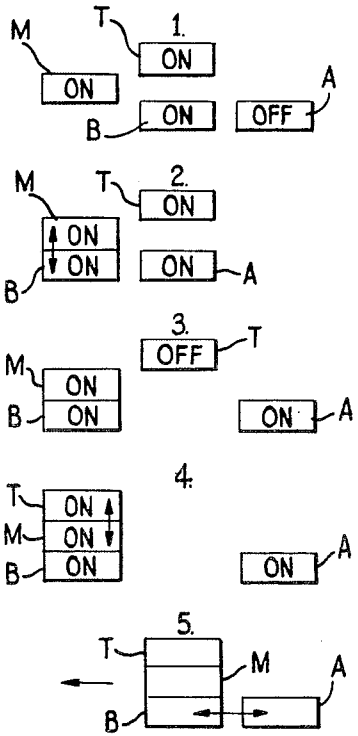
FIG. 8A is a diagram of suction programming for the arrangement shown in FIG. 8.
Figure 8:
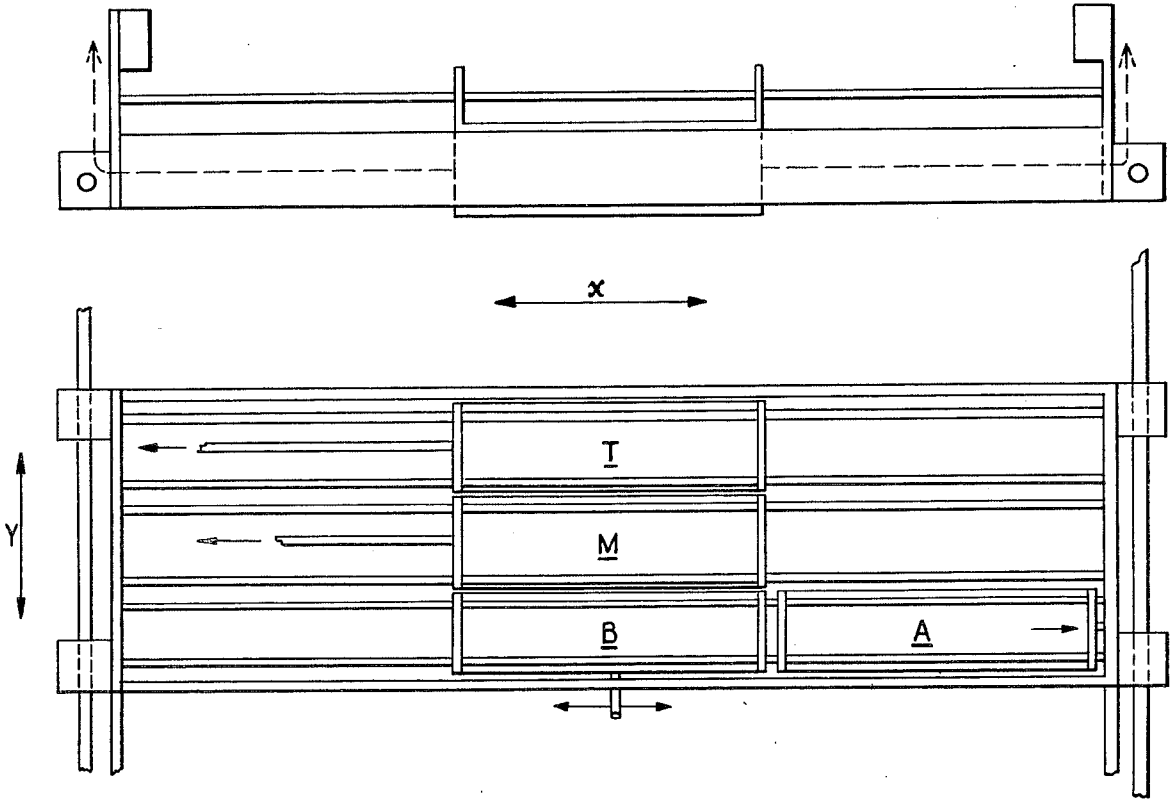
FIG. 8 shows a plan view of a microfiche camera with an alternative three split platen arrangement according to the invention.

In FIG. 8 there is shown a platen arrangement similar to that in FIG. 7 but with three main platens T. M. & B. and an auxiliary platen A instead of two platens. Details of the four platen arrangement need not be explained in detail since they are similar to those of the previously described double platen arrangement. One operating sequence of the four platen arrangement which may be varied will now be described with reference to FIG. 8A.

In situation 1 shown in FIG. 8A platen B is engaged in recording at the filming station, M is at the pick-up station and is preparing to withdraw a microfiche lamina from a cassette. Platen A has released a lamina at the release station having completed titling at the same position.

In the next situation, situation 2, platens B and A are coupled and have together moved to the left under control of an X direction activator and platens B and M are now conterminous at the pick-up station.

In situation 3, A has picked up the lamina on T and is uncoupled from B and by means of a spring has been moved to the titling station. In situation 4, T has moved to a conterminous position with M and B thus forming a single suction platen. Titling meanwhile is being completed on the lamina held by A.

In situation 5, T, M and B have been moved together to the filming station and are moving in a square wave image recording path. When the last column on the path is reached B couples with A and M prepares to move by spring action to the pick-up position having uncoupled from T and B.

In the next situation the platens have returned to the first situation.

In the FIG. 8 arrangement the spring means of T, M and A are attached to the frame and consist of springs which can be wound up; the platens are provided with driving shafts to which flexible drives to the vacuum chambers of the platens are coupled. In the case of platens T and M the spring bias is to the left and in the case of A to the right as seen in FIGS. 8 and 8A. Platen B is coupled to the activator through the frame. This activator can be fitted within the frame or on its outside. To make the frames in which the platens move smaller the means connecting the platens and activators need not be at the end of the platens as shown in FIG. 8 but at the side and can be tiered one on top of the other.

Figure 9:
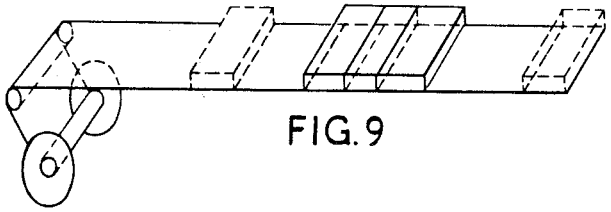
FIG. 9 shows an arrangement according to the invention in which laminae are presented to split platens, the laminae forming part of a roll or film.
Figure 10:
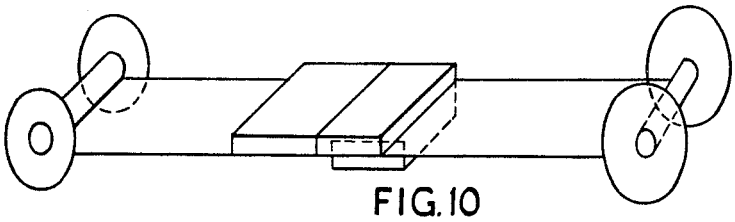
FIG. 10 shows an arrangement in which a two similar split platens are used and a third smaller platen is used for adding additional information such as a title to the laminae carried on a roll film.

In an alternative arrangement of platens shown in FIGS. 9 and 10 the platens are arranged to split along the 'Y' axis. This arrangement is more suitable when using roll film incorporating laminae which may be cut into separate linae either in the camera or in a separate developing unit. The details of the roll film arrangement will not be described since they are essentially similar to those of the FIG. 7 and 8 arrangements. It will be seen that in FIG. 9 there are three platens arranged on top of the film. In FIG. 10 two platens which pick up and hold the laminae incorporated in the roll film at the filming station are on top, or non-emulsion side of the film, whilst a third and auxiliary platen which is of a smaller size to leave the titling space uncovered is on the side facing the filming optics i.e. the emulsion side. Such an auxiliary platen could also be used at the pre-photography end.

As mentioned before, one very important use of the equipment described above is to take intelligence directly from computers. So far the emphasis was placed on the abilities of the device to re-load itself, i.e. pick up new film, while active photography, i.e. positioning, is actually in the progress as well as avoid delays in connection with cutting a film section off (which is usually done inaccurately) or titling either in roll or laminae form. High speed work, these words being used in the context and meaning of microfilm, especially Fiche cameras, will now be described. In conventional photography the speed of the operator governs the pace at which such apparatus is used. But the above devices may be and probably will be used in a combined conventional and COM camera, and, if used in the latter mode, directly on-line, i.e. without an auxiliary buffer, then high speed operation of the positioning device will save expensive computer time. For the purpose of explanation, we will revert to FIG. 7, and we shall start with the Y direction as this is simpler to explain, although the principle in both Y and X directions is the same. If frame 105 is made wider in the Y direction and a drive is applied to it, then this frame can be made to operate continuously and the inner frame 101 can take its motive power through a spring or similar means for its Y movement from frame 105. Thus the mass of the larger carriage need not be accelerated or decelerated and the smaller carriage is held back only as long as the exposure requires it by the positioning mechanism. The speed of the larger carriage is so synchronised to run at a speed only slightly ahead, say one, two or three frames; though it need not run much ahead as the whole line of photography has to take place before advancement is required to the next row. In the Y direction more time is available, i.e. images are read from right to left in an Z movement. However, when using a square wave movement for image placements, the arrangement can be swung through 90° if this brings about a reduction in the relative mass of the more used carriage or frame. As there may be twelve, fourteen or more images in the X direction, depending on the standard in use, any time saving along this axis is more significant with reference to time. Also the use of split vacuum platens results in much smaller masses to be moved and it follows that this can be done very quickly as the only thing the platen has to carry is the lamina (the film usually being of 148 mm by 105 mm and approximately 0.008 inch thick) the weight of which becomes insignificant. Since the vacuum platen as such is made of aluminium alloy, the platen being light can be moved very easily in comparison to the complete frames or carriages. Once again the X carriage is driven continuously, pretensioned springs are tensioned a bit more, and the positioning release mechanism allows these platens to move very quickly from position to position. The X carriage moves continuously in synchronisation with the individual image exposure time applied. As an electronically timed shutter is being used in the camera the speed of the carriage drive can easily be varied to bring both into synchronisation. Thus the film transport image positioning mechanism becomes a function of shutter or exposure speed. The film pick-up and titling work is carried in the manner already described, although alternative lamina pick-up mechanisms will be mentioned. In one of these embodiments, the laminae are stored vertically and a suction device, places a lamina under the suction platen, i.e. the suction device is placed onto a standing lamina and as film is non-porous only the nearest lamina to the suction pad will be attracted. This is then lifted in a semi-circular or similar movement to face the vacuum platen to which it is transferred and which is in the photographic plane of the camera.

Although transport, positioning, and activators enabling exact location in regard to the optical axis of the camera, is dealt with, for example in British Patent Application No. 15574/73 a further type of activator will now be described. In this activator a continuous drive is applied to the carriages so that the bulk of the masses need not be accelerated or decelerated, the speed of this drive is synchronised to the speed at which the shutter operates, because this is the COM configuration, not the operator, is the governing factor. The shutter in its turn depends on the brightness of the image on the cathode ray tube or other display and the speed of the film emulsion.

Figure 11:
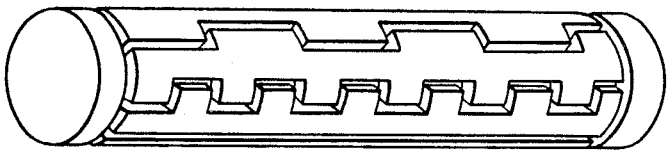
FIGS. 11 to 14 show different kinds of platen activator according to the invention.
Figure 12:
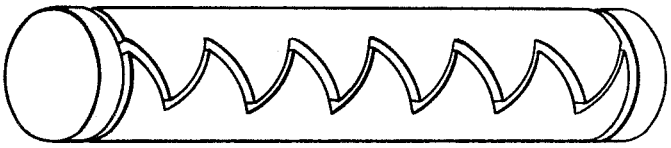
Figure 13:
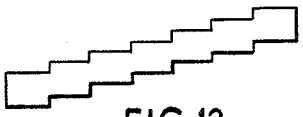
Figure 14:
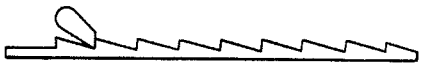

As was also explained previously, the carriages are, so to speak, ahead of the actual photographic platen or platens. Because photography takes place in discrete steps correspondingly to the grid pattern in use at the time, it follows, therefore, that a step and repeat device must still be fitted. Such mechanisms, especially suitable to speedy operation in conjunction with the above will now be described. As the motive power is provided by the carriage which in its turn is driven by a governed motor, the actual film platen or platens require escapements and this can be provided most conveniently by a square wave groove as is shown in FIG. 11 on a reciprocating roller the save length corresponding to the distance the platen is to travel. A large number of such square groove waves can be machined out on a roller each corresponding to a different standard. In FIG. 11 two programmed square wave grooves are shown with a straight return groove and a circumferential safety groove at each end. The safety groove also enables a change from one standard to another. A short slide or round pin is biased (the bias in the first instance comes from the motor via the carriage) and held against the vertical side of the square wave groove, the roller is turned so that it reaches the horizontal part of the square wave, as the restriction in connection with the bias is now removed, the pin and the platen to which it is connected will move until it reaches the other vertical face of the square wave groove. This face is aligned to the optical axis of a photographic image and photography can take place. Immediately the exposure has been completed the roller rotates slightly, i.e. the in travels in the vertical part of the square wave groove and when it reaches the horizontal part once again the restriction is removed and the pin travels to the next vertical face. As very little mass is carried as compared with the complete carriages, movements can be very rapid and work at the speed of the spring tensions or other activators. As most photographic shutter blades are driven by springs and high speeds are achieved by these means, similarly the light weight platens can be a match to these and as a refinement, air or hydraulic dampers can be used just prior to impact so that such a device works very smoothly (dampers are used mainly on high speed focal plane shutters to prevent a recoil of the blinds, i.e. shutter bounce). Thus as there is in mechanical terms a close relationship of shutter operation and platen positioning the overall control of such a system is greatly simplified. As the shutter closes, it can initiate film movement to the next position and vice versa. Alternative escapements will now be described, although some of them may be less advantageous than the one just described. The groove on the roller can take the form of a staircase as is shown in FIG. 12 and by turning the roller slightly, the pin gets arrested against the next stop. A mirror image can face the staircase when a similar return motion is required. If a gap is left between the staircases this can be used for fast return or forward. Another escapement activator shown in FIG. 13 arranged in plate form, but this is more complex in operation. In FIG. 14 a further escapement is shown consisting essentially of a pawl and rack. Whilst a third and auxiliary platen which is of a smaller size to leave the titling space uncovered is on the side facing the filming optics i.e. the emulsion side. Such an auxiliary platen could also be use at the pre-photography end.

Having described with reference to FIGS. 1 to 3 and FIG. 6 two basic holders for microfiche laminae there will now described further embodiments of this aspect of the invention which provide various advantages for specialised use in a microfiche camera.

Figure 15:
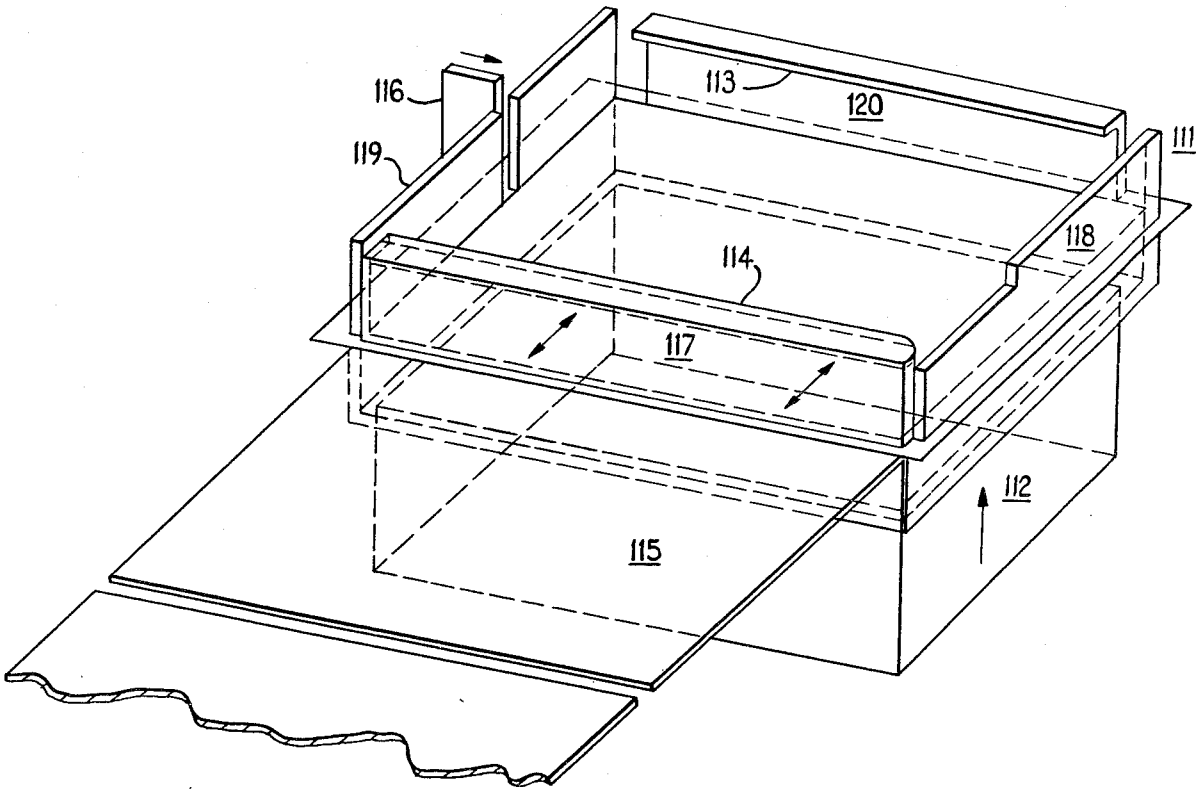
FIG. 15 shows a further example of a holder according to the invention.

In FIG. 15 there is shown a holder having a reference corner 111 and sides 118, 119 and 120. Side 117 and locating number 116 are movable to allow a stack of separate microfiche laminae held in cassette 112 to be urged toward the reference corner 111. Opposing sides 117 and 120 have retaining means formed as lips 114 and 113 respectively. To load the holder, the cassette 112 is pushed home into the holder whilst a spring loaded plunger (not shown) forming part of an exterior feeding arrangement which can be similar to that shown in FIG. 6, is held down. The cassette has a false bottom into which the plunger fits. The plunger serves two purposes, firstly to keep the laminae pressed against the lips 113 and 114 and secondly to lock the cassette into place. The cassette need not be accurately finished as regards size since the final laminae location is ensured by location of the laminae into reference corner 111. The cassette has a cover 115 to permit daylight loading. After this cover has been pulled out and the plunger released, the top lamina of the stack is pressed against the lips 113 and 114. Release of the top lamina can be achieved in this arrangement by a slight movement toward lip 114 on side 117 which is spring loaded to urge the laminae against side 120. By means of a lever arrangement (not shown) pressure can be exerted when loading to align the stack of laminae. Thereafter a springing arrangement is sufficient to realign on misaligned top laminae after withdrawal of each top laminae. Positioning of the fixed sides 118, 119 and 120 are governed by the largest possible laminae size in accordance with laminae tolerances.

Figure 16:
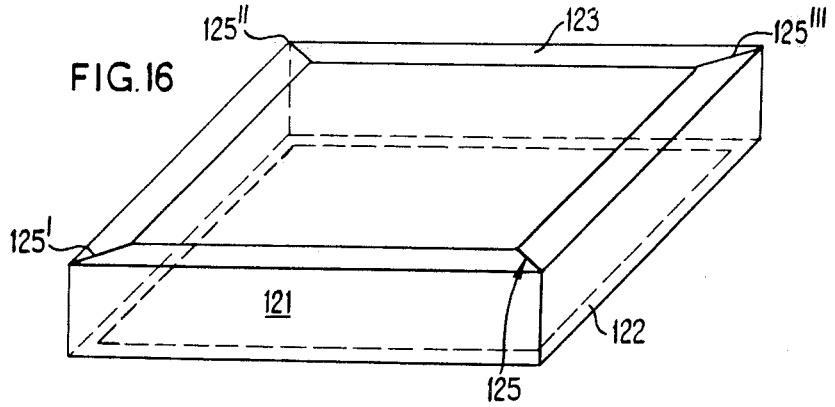
FIGS. 16 to 18 show film laminae containers for insertion into the holder of FIG. 15.
Figure 17:
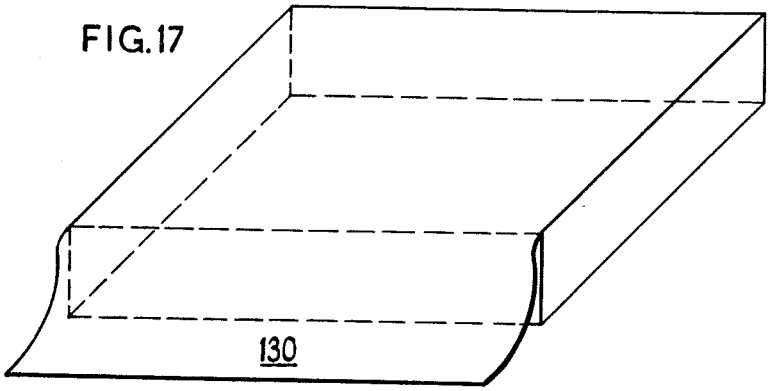
Figure 18:
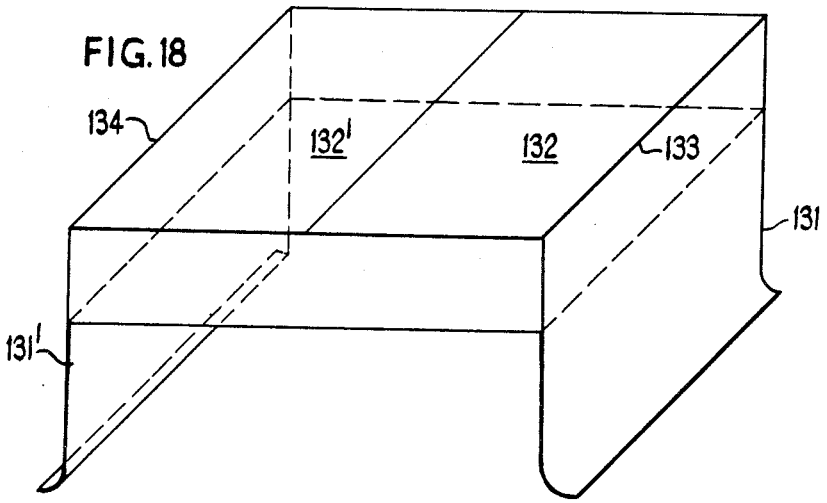

In FIGS. 16 to 18 further details of cassettes 121 has a frame slightly formed from a permanent surround 122 and folded in portions 123 which give at the corners 125, 125', 125'' and 125'''. A light tight cover 130 can be pulled out to uncover the top, as shown in FIG. 17. Alternatively as shown in FIG. 18 two half covers 131 and 131' are pulled off either manually or by the plunger. In the FIG. 18 arrangement two halves 132 and 132' are hinged along edges 133 and 134.

Whilst the invention is specifically described with reference to handling microfiche the invention could well be used for handling other laminae such as sheets of paper.

Figure 19:
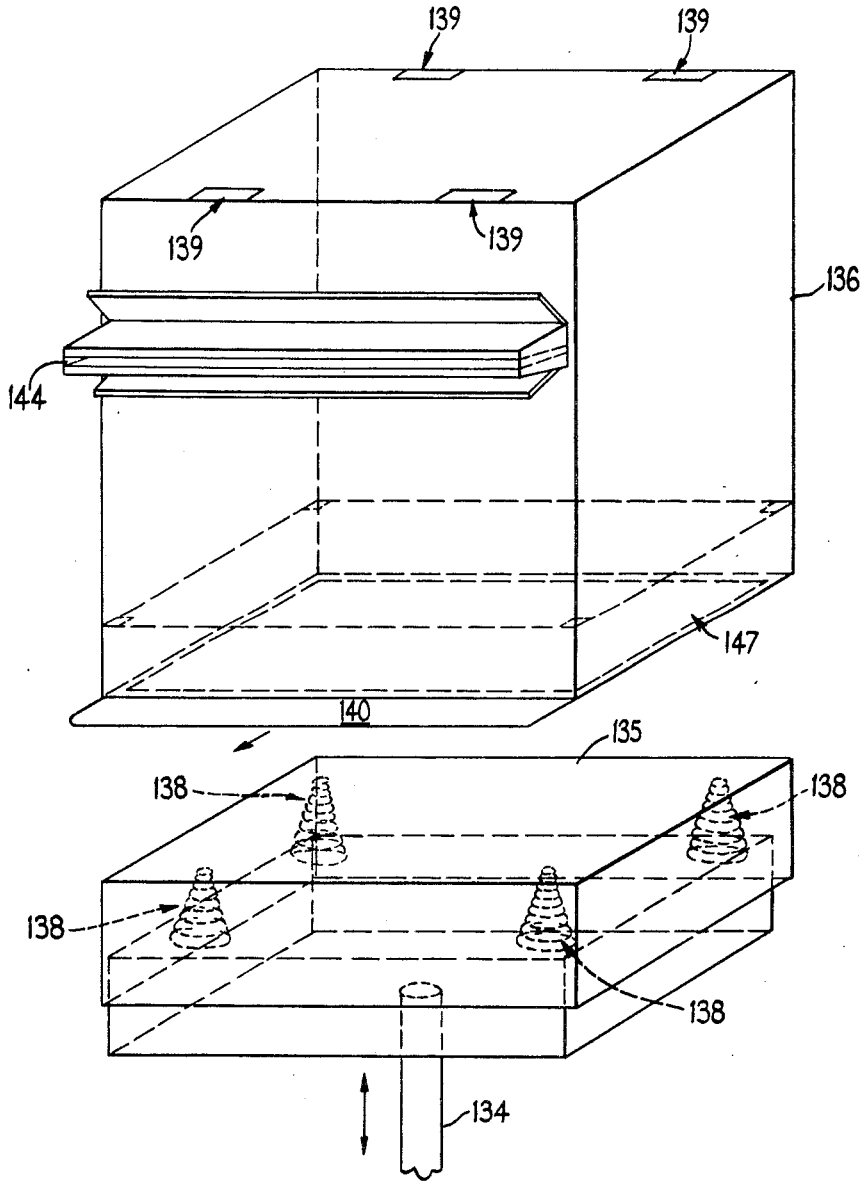
FIG. 19 shows a modified example of a holder according to the invention.

In FIG. 19 a holder is shown into which either a cassette of 50 or 100 laminae similar to that shown in FIGS. 16 to 18 or a single microfiche lamina can be loaded. The holder consists of a frame 136 into which a cassette 137 is loaded at the bottom. At the base of the frame 136 the light tight top 140 of the cassette is removed and the stack of laminae in the cassette pushed upwards by an exterior pusher 134 which acts through springs 138 onto a plate 135 which acts on through the surround 122 of the cassette (see FIG. 16). Continued pressure of the pusher 134 causes the surround 123 of the cassette to open out and the stack of laminae moves upward until the top lamina rests on engaging means 139 formed as lips. In the event that a single microfiche of say a different kind of film has to be inserted into the holder, the stack of laminae is lowered and the single microfiche or even other additional microfiches are inserted through the orifice 144.

In libraries, for example, old manuscripts of various backgrounds and colours may have to be copied and quick changes from ortho to pan or other film is required. Two pictures may have to be taken of the same subject on different film materials, this with or without use of special filters, to bring out all the details of the manuscript, or a leaflet printed entirely in red ink may have to be photographed or in any other colour. No known film can render every colour in the right density, so once again a quick change of film may be required. Some cameras have provisions for up-datable Fiche and for this reason only a partially image covered Fiche may have to be inserted in the middle of a run. Again the above means would be used to insert this single Fiche which is to be added to. With an already exposed Fiche, daylight handling can take place, but with unexposed film, an arrangement such as shown in FIG. 20 will have to be employed.

Figure 20:
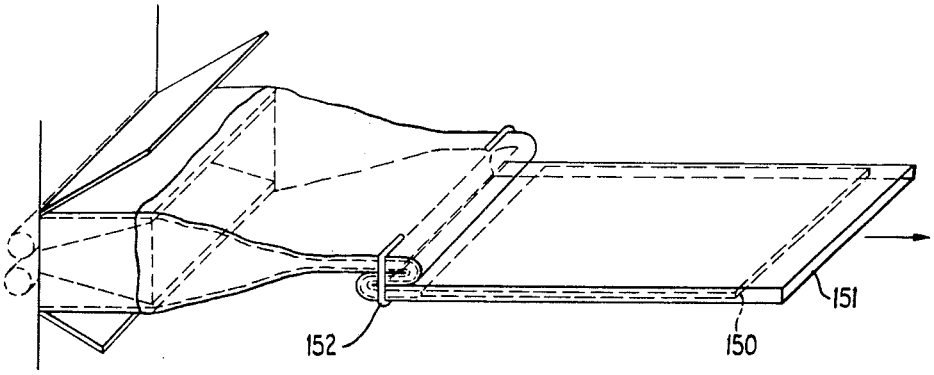
FIGS. 20 to 22 show the insertion of a film laminae into the holder of FIG. 19.
Figure 21:
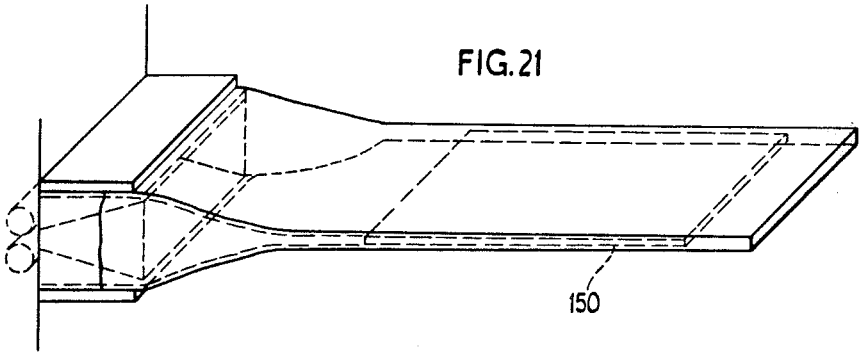
Figure 22:
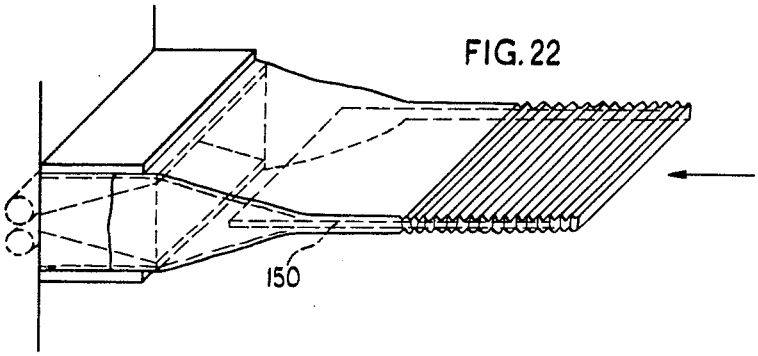

In FIG. 20 arrangement a microfiche 150 is inserted in a sleeve 151 which is fitted in orifice 144 of the holder shown in FIG. 19. Initially the sleeve 151 is clipped by clip 152. In FIG. 21 this is shown removed and the microfiche partially inserted. A further phase of insertion is shown in FIG. 22; embodiments or variations, for example, the two halves as in 12 could be made as a double door hinging on the axes 13, 13' and 14, 14' or 13 to 14 and 13' to 14', or there could be four sections and the like.

Figure 23:
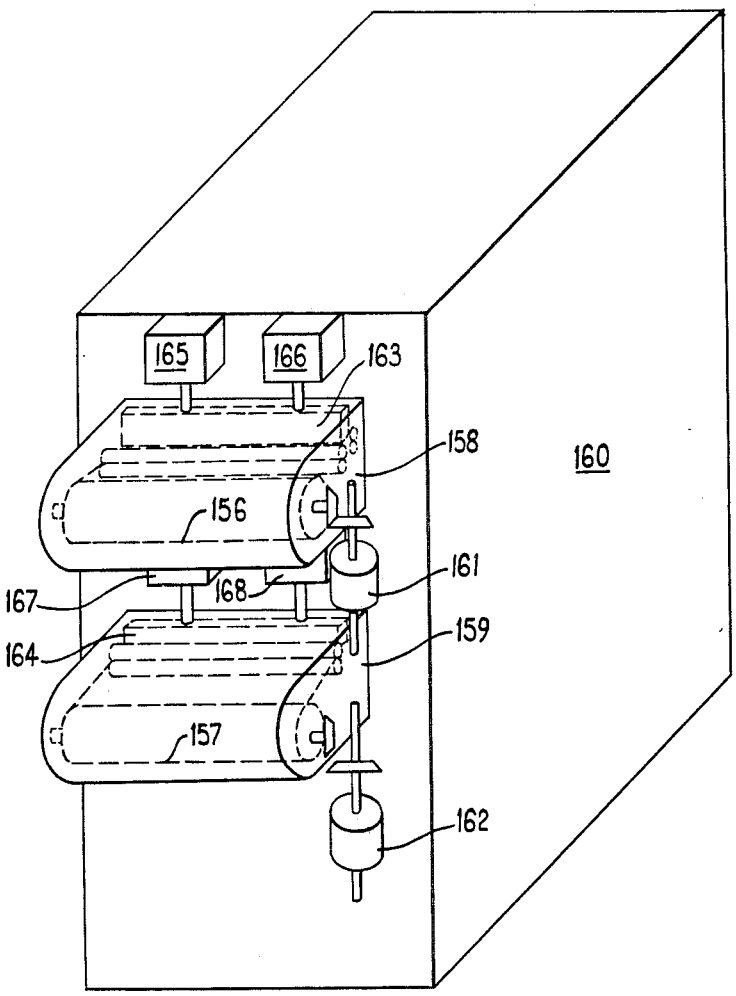
FIG. 23 shows a yet further example of a holder according to the invention in which roll film is converted to individual laminae.

In FIG. 23 there is shown an arrangement in which two or more kinds of roll film can be inserted automatically. In this arrangement roll film reeled on rollers 156 and 157 is contained in cassettes 158 and 159 mounted on one side of a holder 160. The rollers are driven by motors 161 and 162 and the film is chopped into individual laminae by blades 163 and 164 operated on solenoids 165, 166, 167 and 168.

Figure 24:
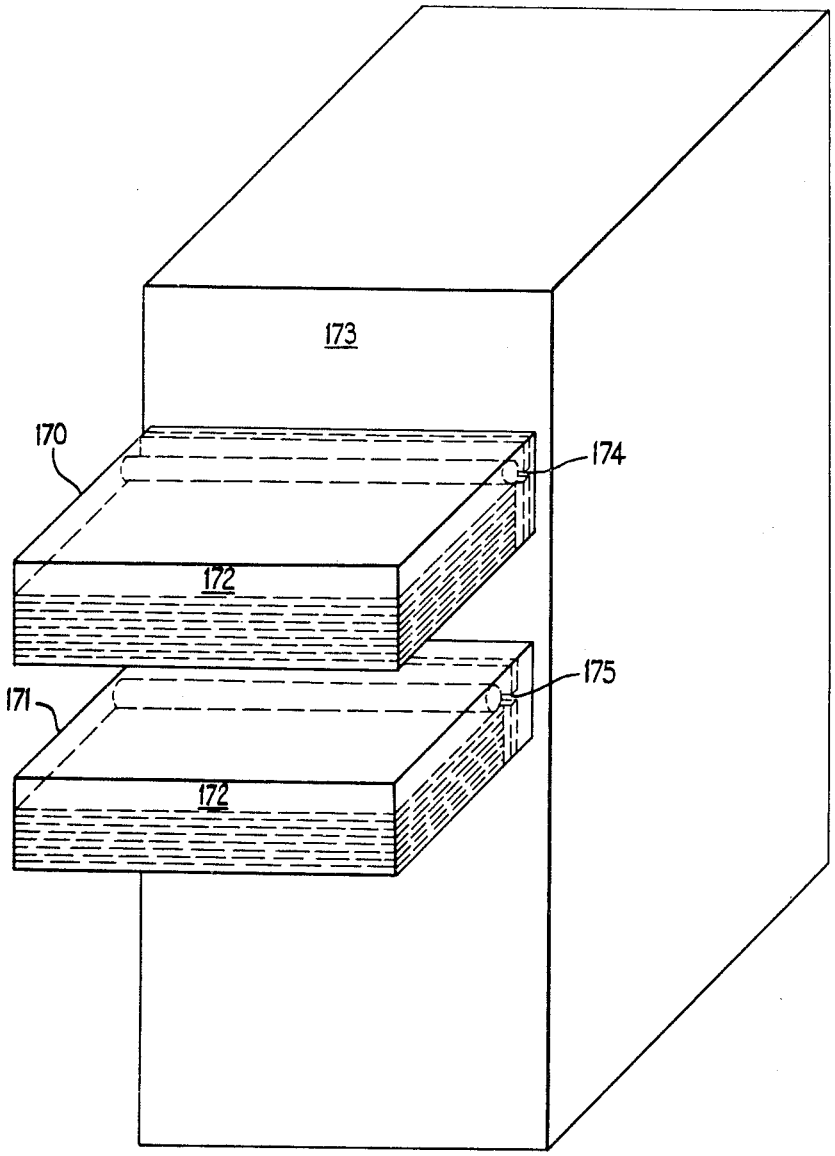
FIG. 24 shows a holder according to the invention which carries magazines of two different kinds of film.

A similar arrangement of cassettes to FIG. 23 is shown in FIG. 24 but in this case the cassettes 170 and 171 are filled with separate laminae 172. These are fed into the side of holder 173 through orifices 174 and 175.

Figure 25:
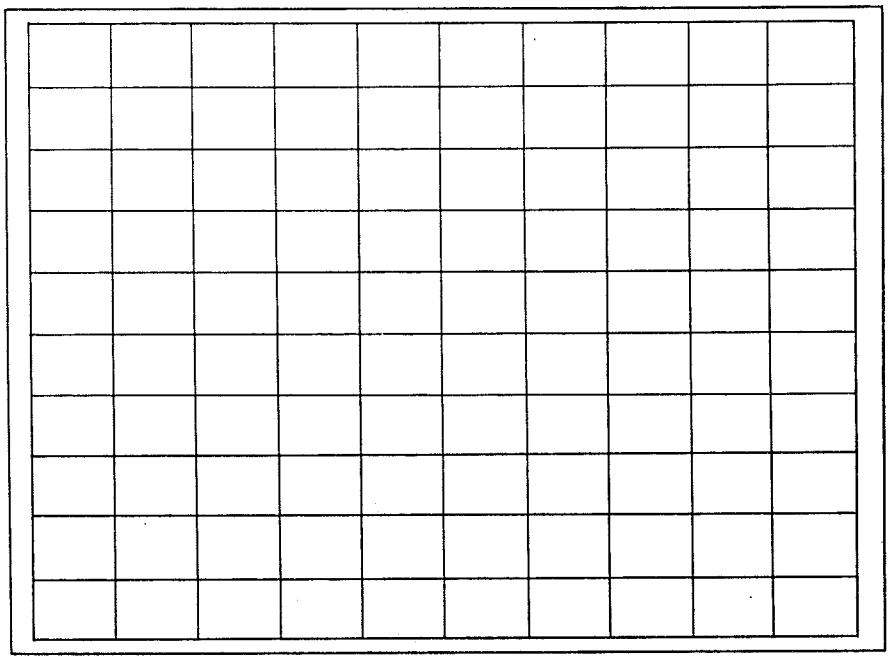
FIGS. 25 and 26 show two sorts of film laminae designed as microfiche as produced by a microfiche camera according to the invention similar to FIG. 9.

In FIGS. 25 and 26 are shown two microfiche laminae based on the 148 mm by 105 mm standard. The first microfiche shown in FIG. 25 has 100 frames arranged in a 10 row by 10 column configuration. This is suitable for use in a decimal coded or binary high speed retrieval system. The second microfiche shown in FIG. 26 has 216 square frames in a 12 row by 18 column configuration which has already been described as being suitable for computer recording. The FIG. 26 microfiche also has space at 180 for a title or coded strip.

Whilst the invention is specifically described with reference to handling microfiche the invention could well be used for handling other laminae such as sheets of paper.

What I claim is:

1. In a film handling apparatus which comprises a holder having means for engaging at least one marginal portion of a lamina positioned at a pick-up station, the improvement comprising a handling device positionable at the pick-up station in adjacent relationship to the lamina, said device including platen means having first suction means engagable with a central area of the lamina and having additional suction means engagable with another area of the lamina adjacent the lamina edge, the first suction means and additional suction means forming a plane platen face, and means to apply suction first to said first suction means and thereafter to apply suction to said additional suction means.

2. Apparatus as claimed in claim 1 wherein two or three similar said platen means are provided mounted in close relationship on guides.

3. Apparatus as claimed in claim 1 wherein the platen means are provided with control means so that the platen means can work together or separately.

4. Apparatus as claimed in claim 1 wherein said platen means are provided with separate primary and secondary suction chambers which communicate with apertures grouped respectively in a first and second suction area on a suction platen face, separate conduits communicating with the primary and secondary chambers, each conduit being connectable to a source of suction via a control device, and wherein the first suction area is arranged to attract a central area of the lamina and the second suction area is arranged to attract one marginal portion of the lamina.

5. Apparatus as claimed in claim 1 wherein the platen means includes a suction platen having three or more suction chambers, an inner of said chambers being connectable by a conduit to a source of suction, a second said chamber adjacent the inner chamber being connectable by a conduit to the source of suction to the second chamber, wherein the inner chamber is in communication with a primary suction area and the other chambers are in communication with a secondary area.

6. Apparatus as claimed in claim 1 wherein a fail-safe device is provided on the suction means so that if suction to the means fails a lamina held to the suction means is retained thereon.

7. Apparatus as claimed in claim 4, wherein a control device is provided to sense the fact that the primary or inner chamber has collected a lamina and the lamina is partly withdrawn from the holder.

* * * * *